US012350732B2

(12) United States Patent
Schmitt et al.

(10) Patent No.: US 12,350,732 B2
(45) Date of Patent: Jul. 8, 2025

(54) METHOD FOR PRODUCING A SINTERED PART

(71) Applicant: GKN Sinter Metals Engineering GmbH, Radevormwald (DE)

(72) Inventors: Rainer Schmitt, Wachtberg (DE); Christian Siegert, Ahrweiler (DE); Maurits van de Velde, Bornheim (DE); Stefan Tiller, Sankt Augustin (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 123 days.

(21) Appl. No.: 17/784,842

(22) PCT Filed: Dec. 11, 2020

(86) PCT No.: PCT/EP2020/085726
§ 371 (c)(1),
(2) Date: Jun. 13, 2022

(87) PCT Pub. No.: WO2021/116386
PCT Pub. Date: Jun. 17, 2021

(65) Prior Publication Data

US 2023/0009436 A1 Jan. 12, 2023

(30) Foreign Application Priority Data

Dec. 12, 2019 (DE) ..... 10 2019 134 155.8

(51) Int. Cl.
*B21J 5/02* (2006.01)
*B22F 3/24* (2006.01)

(52) U.S. Cl.
CPC .. *B21J 5/02* (2013.01); *B22F 3/24* (2013.01)

(58) Field of Classification Search
CPC ..... B21J 13/025; B21J 9/027; B21K 1/30; B21H 5/02; B21H 5/04
See application file for complete search history.

(56) References Cited

U.S. PATENT DOCUMENTS 4,940,565 A 7/1990 Müller
6,085,418 A 7/2000 Matsubara et al.
(Continued)

FOREIGN PATENT DOCUMENTS

CN 1314222 A 9/2001
CN 1826199 A 8/2006
(Continued)

OTHER PUBLICATIONS

PCT International Search Report and Written Opinion and translation thereof, PCT/EP2020/085726, Mar. 25, 2021, 24 pages.
(Continued)

*Primary Examiner* — Debra M Sullivan
(74) *Attorney, Agent, or Firm* — Quarles & Brady LLP

(57) ABSTRACT

A method for producing a sintered part, having at least the following steps: a) providing a sintered part, said sintered part having a first end face, a second end face arranged at a distance from the first end face in an axial direction, and a circumferential surface between the end faces; b) arranging the sintered part in a tool; c) applying a first pressure force, which acts on the end faces at least in the axial direction, to the sintered part by means of the tool; and d) applying a second pressure force, which acts on the circumferential surface at least in a radial direction, to the sintered part, wherein the sintered part is reshaped at least by the second pressure force, or mechanically processing the sintered part. Steps c) and d) are carried out at least partly simultaneously.

7 Claims, 2 Drawing Sheets

(56) References Cited

U.S. PATENT DOCUMENTS

Figure 1:
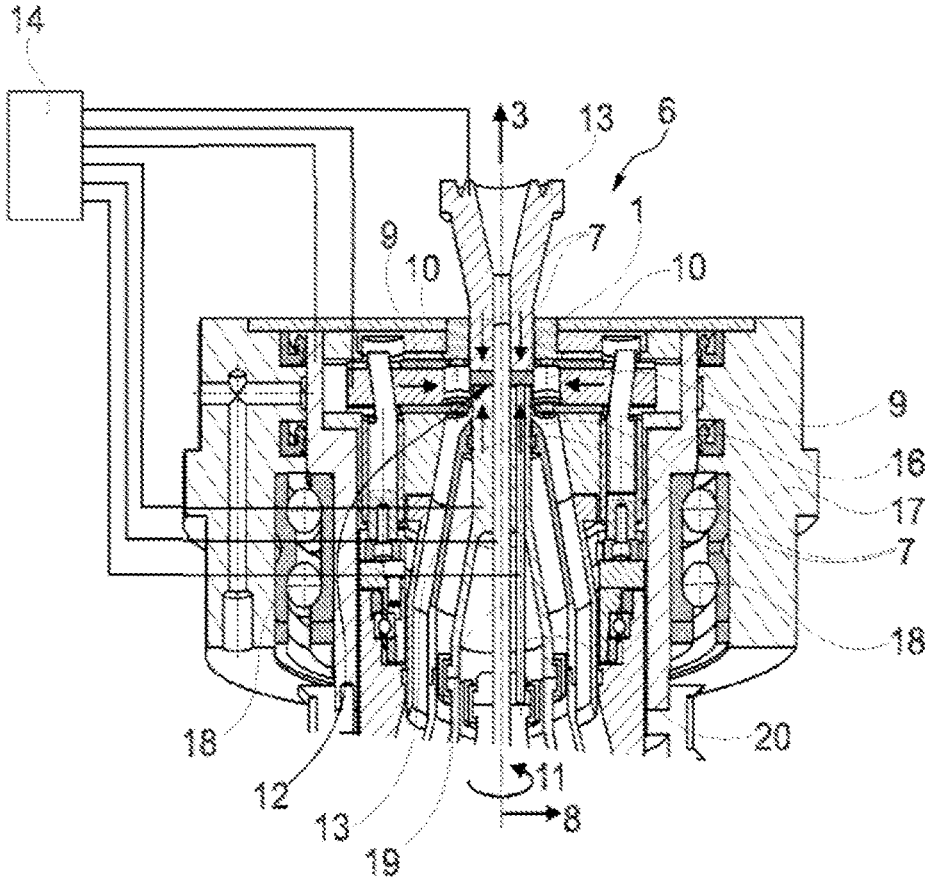

| | | | | |
|---|---|---|---|---|
| 6,101,713 | A | 8/2000 | May et al. | |
| 2008/0282544 | A1 | 11/2008 | Lawcock et al. | |
| 2015/0209858 | A1 | 7/2015 | Kruzhanov et al. | |
| 2019/0262891 | A1* | 8/2019 | Hirayama | B21K 1/30 |

FOREIGN PATENT DOCUMENTS

| | | | | |
|---|---|---|---|---|
| CN | 103732386 | A | 4/2014 | |
| DE | 20115860 | U1 | 12/2001 | |
| DE | 102012017040 | A1 | 3/2014 | |
| DE | 202014001646 | U1 | 4/2014 | |
| DE | 102012024030 | A1 | 6/2014 | |
| DE | 102006041584 | B4 | 10/2015 | |
| DE | 102015211657 | B3 | 6/2016 | |
| EP | 0735247 | A1 | 10/1996 | |
| JP | 57-41303 | A * | 3/1982 | B21H 1/02 |
| JP | S5741303 | A | 3/1982 | |
| JP | H07102305 | A | 4/1995 | |
| JP | H07112231 | A | 5/1995 | |
| JP | H07148598 | A | 6/1995 | |
| JP | H1157926 | A | 3/1999 | |
| JP | 2011074953 | A | 4/2011 | |
| JP | 2019143750 | A | 8/2019 | |
| KR | 1020120007235 | A | 1/2012 | |

OTHER PUBLICATIONS

Timokhova, "Quasi-Isostatic Pressing Technique for Powdered Materials," Refractories and Industrial Ceramics, US. vol. 44. No. 6. Nov. 1, 2003 (Nov. 1, 2003). pp. 364-366 DOI: 10.1023/B:REFR.0000016771.06844.04 ISSN: 1083-4877. XP055786078.

Japan Patent Office, Notice of Reasons for Refusal and Search Report, Application No. 2022-535462, Jul. 11, 2023, 33 pages.

The State Intellectual Property Office of People's Republic of China, First Office Action, Application No. 202080096512.6, Dec. 31, 2024, 20 pages.

* cited by examiner

METHOD FOR PRODUCING A SINTERED PART

This application represents the U.S. national stage entry of International Application No. PCT/EP2020/085726 filed Dec. 11, 2020, which claims priority to German Patent Application No. 10 2019 134 155.8 filed Dec. 12, 2019, the disclosure of which is incorporated herein by reference in its entirety and for all purposes.

The invention relates to a method for producing a sintered part. The sintered part is produced in particular from a powdered material by pressing to form a green compact and subsequently by sintering to form a solid workpiece (the sintered part).

Sintered parts of this type can be reworked by a follow-up pressing operation, what is referred to as calibration, in order to obtain a greater degree of dimensional accuracy or an at least locally higher density. The calibration is usually done by subjecting the sintered part to a first compressive force, which is caused to act on the sintered part in an axial direction by a calibrating tool.

Sintered parts of this type can also be reworked, i.e. shaped or further compacted, by a rolling process (also referred to as rolling). In the rolling process, the sintered part is subjected to a second compressive force acting in the radial direction.

The calibration and rolling are generally carried out one after the other in time in tools that are independent of one another. The sintered part must first be arranged and processed in the first tool (calibrating tool or rolling tool). The processed sintered part is then removed from the first tool and arranged in the second tool (rolling tool or calibrating tool).

DE 10 2015 211 657 B3 and DE 10 2006 041 584 B4 disclose, among other things, methods for producing components wherein the components are sintered parts which, after calibration, are processed by a rolling process.

It is an object of the present invention to at least partially solve the problems mentioned in relation to the prior art. In particular, the intention is to propose a method for producing a sintered part, wherein the method makes it possible to machine a sintered part more quickly and cost-effectively. In this respect, the method should make it possible to obtain a high degree of dimensional accuracy and a precisely set density of the sintered part. It should also be possible to produce complex structures with high reproducibility.

A method having the features of claim 1 contributes to achieving these objects. The dependent claims relate to advantageous embodiments. The features set out individually in the claims may be combined with one an-other in any technologically meaningful way and may be supplemented by explanatory substantive matter from the description and/or details from the figures, with further embodiment variants of the invention being shown.

A method for producing a sintered part is proposed. The method comprises at least the following steps:

a) providing a sintered part, wherein the sintered part has a first end face, a second end face spaced apart in an axial direction, and a peripheral surface between the end faces;

b) arranging the sintered part in a tool;

c) using the tool to subject the sintered part to a first compressive force acting on the end faces at least in the axial direction;

d) subjecting the sintered part to a second compressive force acting on the peripheral surface at least in a radial direction, wherein the sintered part is shaped at least by the second compressive force, or mechanically processing the sintered part.

Steps c) and d) are carried out at least partially at the same time.

The above (non-conclusive) subdivision of the method steps into a) to d) is intended to serve primarily only for distinguishing purposes and not to dictate any sequence and/or dependency. The frequency of the method steps may also vary. Equally, it is possible for method steps to at least partially overlap in time. Method step d) very particularly preferably takes place during step c). Preferably, at least steps a) to c) are performed in the stated sequence.

The sintered part provided in step a) is produced in particular from a powdered material by pressing to form a green compact and subsequently by sintering to form a solid workpiece (the sintered part).

In particular, the powdered material used for the production of the green compact at least partially comprises a metallic material. Furthermore, in particular a binder used to bond the metallic material to form the green compact is provided. In preparation for the sintering process, the binder is first removed from the metallic material. During the sintering, the green compact or the binder-free brown compact is subjected to a temperature that is only slightly below a melting temperature of the metallic material, with the result that the metallic particles bond to one another by way of the formation of sintering necks and a sintered part with a settable density is created.

In step b), the sintered part is arranged in the tool, e.g. in a receptacle of the tool.

In step c), the tool is used to subject the sintered part to a first compressive force acting on the end faces at least in the axial direction. For this, the tool has in particular at least a first punching unit, which can be moved relative to the sintered part and at least partially contacts one of the end faces. If appropriate, a second punching unit, which can be moved relative to the sintered part and contacts the other one of the end faces, is provided. Each punching unit may also have a multi-part design, so that a specific part of the respective end face is contacted by each part of the respective punching unit.

In particular, at least part of each end face is subjected to the first compressive force. In particular, at least 50% of an end face is subjected to the first compressive force.

In step d), the sintered part is subjected to a second compressive force acting on the peripheral surface at least in a radial direction. As an alternative or possibly in addition, in step d) the sintered part is mechanically processed, e.g. by machining (e.g. turning).

The sintered part is shaped and/or further compacted at least by the second compressive force and steps c) and d) are carried out at least partially at the same time. In particular, the sintered part is subjected to the second compressive force only when the sintered part is also subjected to the first compressive force.

The first compressive force is used at least to assist the shaping or further compaction brought about by the second compressive force. In particular, the first compressive force does not shape and/or further compact the sintered part.

As an alternative or in addition, the first compressive force at least shapes and/or further compacts the sintered part, at least in the region of one of the two end faces.

This further compaction or shaping of a sintered part is referred to as calibration. This makes it possible to obtain e.g. a greater degree of dimensional accuracy of the sintered part or an at least locally higher density.

In particular, the first compressive force is at least 200 megapascals [MPa], preferably at least 500 MPa, particularly preferably at least 1000 MPa.

In particular, the second compressive force is at least 200 megapascals [MPa], preferably at least 500 MPa, particularly preferably at least 1000 MPa.

The combination of the first compressive force and the second compressive force, i.e. in particular subjecting the sintered part to these compressive forces at least partially at the same time, makes it possible in particular to produce certain properties of the sintered part that hitherto at least in part were not able to be realized.

When calibrating and rolling processes are carried out in succession, cracks can form due to the high stress gradients in the sintered part. As a result of subjecting the sintered part to the first compressive force and the second compressive force at least partially at the same time, it is possible to reduce these stress gradients in the sintered part.

In particular, the compressive forces acting on all surfaces (end faces, peripheral surfaces) make it possible to counteract undesired deformation (plastic flow into free spaces) e.g. during rolling, and/or to controlledly introduce this plastic deformation selectively into defined and precisely re-producible regions of the sintered part.

In particular, this method is applicable in the case of sintered parts with high initial porosity, e.g. a porosity of at least 15%, in particular at least 20%, preferably at least 25%. As a result of the application of compressive forces via the end faces and the peripheral surface, large compressive forces make it possible to generate high stresses in the sintered part and thus to obtain a very great degree of shaping and a great degree of compaction (to densities of at least 95%, in particular of at least 97%, preferably at least 98%) combined with a low risk of cracking and very high precision.

Due to the combination of the calibrating and rolling or mechanical processing methods, it is possible in particular to considerably shorten the processing of the sintered part. In particular, it is only necessary to clamp the sintered part into a tool once (previously at least twice, once into the calibrating tool and once into the rolling tool and/or processing tool). The handling of the component (provision for the first tool and subsequently for the second tool, in addition to interim transport of the sintered part to the other tool) is considerably reduced. The processing time is also shortened, since now calibrating and rolling and/or mechanical processing can be carried out at least intermittently parallel to one another.

The space requirement for the processing of the sintered part can also be reduced, since only one tool is required.

Consolidating the processing methods (calibrating, rolling, mechanical processing) in particular makes it possible to save on a clamping technique for the sintered part that would otherwise be required for the rolling or for the mechanical processing. In the present case, the required clamping force is generated by way of the at least one punching unit and the first compressive force. This results in particular in greater flexibility in terms of the surfaces of the sintered part that are to be shaped by rolling.

In particular, given small sintered parts (e.g. given sintered parts with an end face of at most 10 $cm^2$ [square centimeters], in particular at most 7 $cm^2$, preferably at most 5 $cm^2$), it allows the sintered parts to be supported on their entire peripheral surface by the rolling tool partially also with respect to the axial direction (in addition to the support provided by the components of the tool that apply the first compressive force, e.g. the at least one punching unit). This is made possible since the first compressive force, acting in the axial direction, for the calibrating can be made high enough that a plastic deformation in the sintered part is produced by this application of the first compressive force. During conventional rolling, by contrast, the clamping forces should typically be selected such that the plastic-elastic yield point of the material of the sintered part is not reached, since in this instance deformation is not desired. Accordingly, in the case of the calibrating and rolling proposed here, which are carried out at least intermittently in parallel, considerably smaller surfaces for clamping in the sintered part are sufficient and correspondingly the tools clamping in the sintered part with respect to the axial direction are made smaller, with the result that more surface area is exposed for bearing against the rolling tool and for shaping and/or further compaction by the rolling tool.

In the case of the above-mentioned small sintered parts, but also in the case of larger sintered parts, the almost comprehensively possible clamping of the sintered part in the tool makes it possible to selectively and highly intensively shape even very small regions of the sintered part. In the process, the high compressive stresses required for this in the regions of the sintered part that adjoin the parts of the peripheral surface with which the rolling tool makes contact do not result in cracks in the material of the sintered part or in undesired deformations of the sintered part.

In particular, the following advantages can be obtained with the combined method:

- The geometries that can be produced are expanded by radial features or features on the peripheral surface (peripheral grooves, bevels, chamfers, burring, rounding, low wall thicknesses (at most 0.8 mm [millimeters], geometry/shape changes, angles, etc.).
- The density in the sintered part can also be greatly increased in local regions.
- Increase in strength near the surface as a result of cold work-hardening or cold forming.
- The surface quality can be improved.
- Diameter tolerance can be greatly improved.
- Concentricity tolerances can be improved.
- Production of thin-walled sintered parts with a large length in the axial direction is possible, e.g. ratio of length to wall thickness of more than 20. In this respect, it is now possible to realize the highest possible and at the same time, if appropriate, homogeneous density in the sintered part.
- Creation of small wall thicknesses, which up to now were not able to be produced in the case of green compacts or by calibration alone, e.g. due to the necessary separation processes of the tools during the production of the green compact or during calibration.
- Production of conical portions of the sintered part, in particular with angles of less than 60 angular degrees with respect to the axial direction.
- Production of radial formations and/or undercuts and also peripheral grooves on the sintered part.
- Creation of locally modified densities in the sintered part by way of the second compressive force.
- Creation of a density of at least 98%, in particular of at least 99%, preferably of at least 99.5%, at least in regions of the peripheral sur-face.

In particular, the first compressive force is applied to the sintered part over at least 75%, preferably over at least 90%, particularly preferably over at least 95% of the first end face and/or second end face. In particular, the first compressive force is applied to the sintered part over the entire first end face and/or the entire second end face.

In particular, the second compressive force is applied to the sintered part by way of at least one rolling tool. The at least one rolling tool is in particular a constituent part of the tool. By means of the at least one rolling tool, the sintered part arranged in the receptacle of the tool and at least fixed by the first compressive force can be processed on its peripheral surface, if necessary in particular on its entire peripheral surface.

A rolling tool comprises in particular a roller which is guided at least or exclusively in a peripheral direction along the peripheral surface of the sintered part. The second compressive force is applied to the sintered part via the roller. In particular, the roller rolls on the sintered part in the process. The outer peripheral surface of the rolling tool may have a specific shape, with the result that this specific shape is transferred to the sintered part via the rolling tool in the course of the rolling operation.

In particular, a plurality of rolling tools are arranged in the tool in a peripheral direction, with the second compressive force being applied to the sintered part at least intermittently at the same time by multiple rolling tools.

In particular, the statements relating to the rolling tool apply in the same way for the mechanical processing and for a processing tool used for this, e.g. a turning chisel.

In particular, the sintered part is pressed quasi-isostatically by the first compressive force and the second compressive force. In particular, the first compressive force and the second compressive force thus substantially balance out stress in the sintered part, since forces act on the sintered part both in the axial direction and in the radial direction (depending on the number and size of the regions of the peripheral surface with which contact is made). In particular, the compressive forces are set such that the lowest possible stress gradients are present in the sintered part. In particular, the first compressive force and the second compressive force thus have the same magnitude or at least have the same orders of magnitude (i.e. 100 to 999 MPa, or 1000 to 9999 MPa, etc.).

In particular, the sintered part is also at least partially shaped by the first compressive force. In particular, the sintered part is at least partially further compacted by the first compressive force.

A tool for producing a sintered part by the method described is also proposed. The sintered part has a first end face, a second end face spaced apart in an axial direction, and a peripheral face between the end faces. The tool comprises at least

- a receptacle, in which the sintered part can be arranged for further processing,
- a punching unit for subjecting the sintered part arranged in the receptacle to the first compressive force, and
- at least one rolling tool for subjecting the sintered part arranged in the receptacle to the second compressive force, or at least one processing tool for the mechanical processing of the sintered part arranged in the receptacle.

In particular, the tool comprises at least one control unit suitably designed (equipped, configured or programmed) to control the tool for the purpose of carrying out the method, with the control unit being able to control the first compressive force and additionally the second compressive force or the processing tool at least intermittently at the same time.

In particular, a punching unit, the punch(es) of which can be moved in the axial direction with respect to the sintered part, is provided on each side of the sintered part.

In particular, the at least one rolling tool or the processing tool is arranged in a radial direction next to the receptacle for the sintered part. It is the case that either the rolling tool or the processing tool rotates around the sintered part in the peripheral direction, or the sintered part is rotated (in particular together with the punching unit).

What is also proposed is a sintered part, at least having a first end face, a second end face spaced apart in an axial direction, and a peripheral surface between the end faces. The sintered part is produced at least by the method described or by the tool described.

The statements relating to the method apply in particular in the same way to the tool and the sintered part, and vice versa.

The use of indefinite articles ("a" and "an"), in particular in the claims and the description reflecting them, should be understood as such and not as a numerical term. Correspondingly introduced terms or components are to be understood such that they are present at least once but in particular can also be present multiple times.

It is pointed out by way of precaution that the numerical terms used here ("first", "second", etc.) serve primarily (only) for distinction between multiple similar objects, dimensions or processes, that is to say in particular do not imperatively specify any dependency and/or sequence of these objects, dimensions or processes in relation to one another. Should a de-pendency and/or sequence be necessary, this is explicitly stated here, or is obvious to a person skilled in the art when studying the specifically described embodiment. If a component can occur more than once ("at least one"), the description relating to one of these components can similarly apply to all or some of the plurality of these components, but this is not mandatory.

Figure 2:
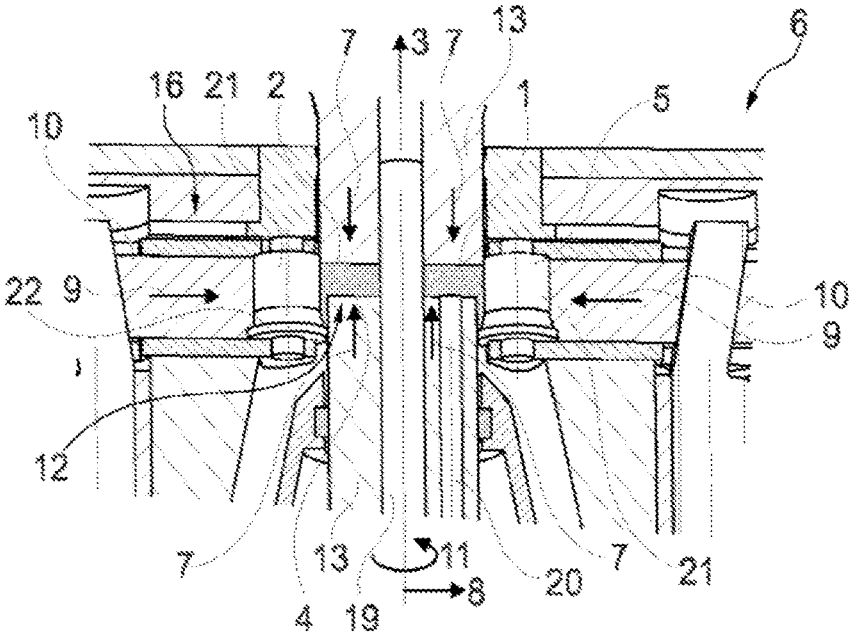
Figure 3:
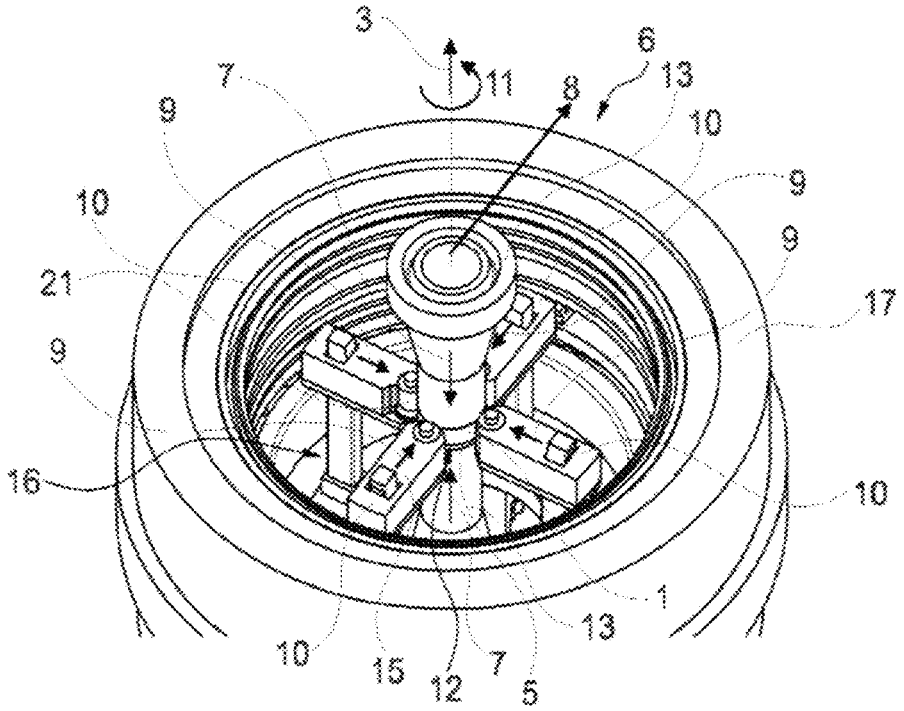
Figure 4:
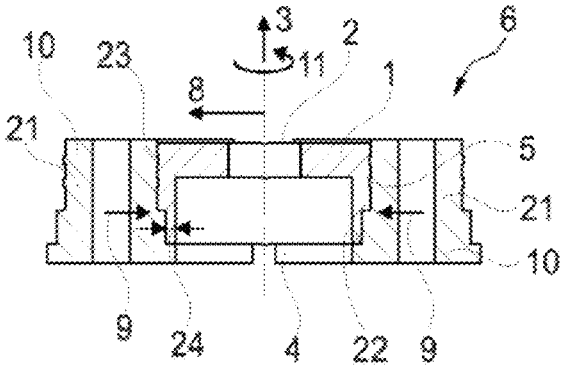
Figure 4:
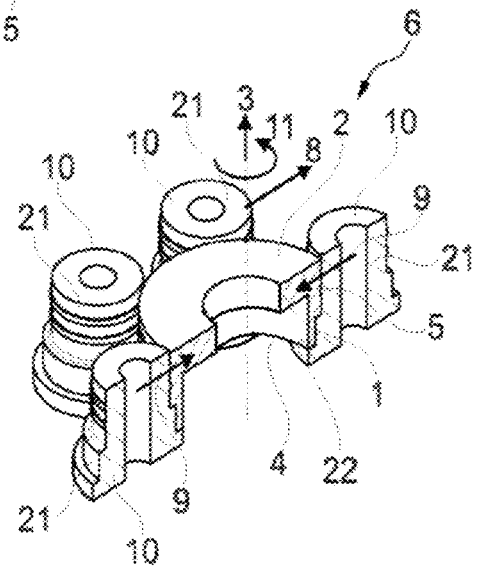
Figure 5:
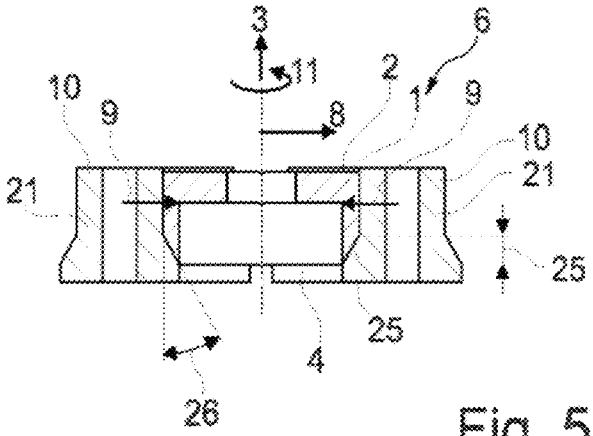
Figure 5:
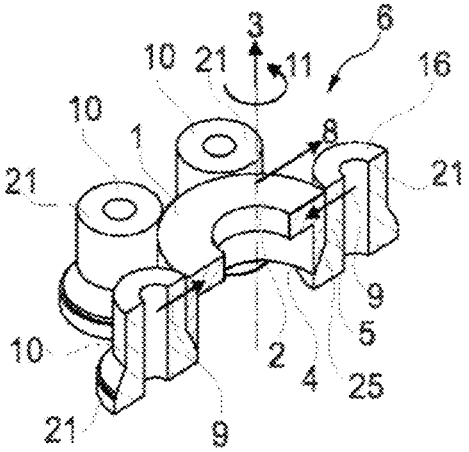

The invention and the technical field will be explained in more detail below on the basis of the appended figures. It is to be noted that the invention is not intended to be limited by the exemplary embodiments mentioned. In particular, unless explicitly stated otherwise, it is also possible to extract partial aspects of the explanatory substantive matter illustrated in the figures and to combine these with other constituent parts and findings from the present description. In particular, it is to be noted that the figures and in particular the size ratios illustrated are only schematic. In the figures:

FIG. 1: shows a side view in section of a tool;

FIG. 2: shows a side view in section of a detail of the tool according to FIG. 1;

FIG. 3: shows a perspective view of at least part of the tool according to FIG. 1;

FIG. 4: shows a side view in section (left-hand side) and a perspective view in section (right-hand side) of a first embodiment variant of rolling tools in the tool according to FIG. 1; and FIG. 5: shows a side view in section (left-hand side) and a perspective view in section (right-hand side) of a second embodiment variant of rolling tools in the tool according to FIG. 1.

FIG. 1 shows a side view in section of a tool 6. FIG. 2 shows a side view in section of a detail of the tool 6 according to FIG. 1. FIG. 3 shows a perspective view of at least part of the tool 6 according to FIG. 1. FIGS. 1 to 3 will be described jointly below.

The tool 6 comprises a receptacle 12, in which the sintered part 1 is arranged for further processing. The tool 6 also comprises an upper punching unit 13 above the receptacle 12 and a lower punching unit 13 below the receptacle 12 for the purpose of subjecting the sintered part 1 arranged in the receptacle 12 to the first compressive force 7. The lower punching unit 13 has a first mandrel 19 and a second mandrel 20 (or punch). The receptacle 12 is formed in this instance by way of the punching units 13. Furthermore, four rolling tools 10 are provided for subjecting the sintered part 1 arranged in the receptacle 12 to the second compressive force 9.

The rolling tools 10 are arranged in a radial direction 8 next to the receptacle 12 for the sintered part 1. The rolling tools 10 are arranged such that they can rotate with respect to the sintered part 1 and the punching units 13 and are able to rotate together around the sintered part 1 in the peripheral direction 11. For this purpose, the rolling tools 10 are arranged in a rotatable first tool part 16 which is mounted rotatably with respect to a stationary second tool part 17 via bearings 18.

Each rolling tool 10 comprises a roller 21, which is guided at least or exclusively in a peripheral direction 11 along the peripheral surface 5 of the sintered part 1. The second compressive force 9 is applied to the sintered part 1 via the roller 21. The roller 21 rolls on the sintered part 1 in the process. The outer peripheral surface of the roller 21 of the rolling tool 10 has a specific shape, with the result that this specific shape is transferred to the sintered part 1 via the rolling tool 10 in the course of the rolling operation. It can be seen in FIG. 2 that the roller 21 has a shoulder 22, which also supports the sintered part 1 with respect to the axial direction 3.

The sintered part 1 has a first end face 2, a second end face 4 spaced apart in an axial direction 3, and a peripheral face 5 between the end faces 2, 4.

The tool 6 comprises a control unit 14 suitably designed (equipped, configured or programmed) to control the tool 6 for the purpose of carrying out the method, with the control unit 14 being able to control the punching units 13 with the mandrels 19, 20, and therefore the first compressive force 7, and additionally the rolling tools 10 and the first tool part 16, and therefore the second compressive force 8, at least intermittently at the same time.

It is pointed out that, instead of e.g. one or each rolling tool 10 (or in addition thereto), a processing tool 15 may be arranged in the tool 6 for the purpose e.g. of machining the peripheral surface 5 of the sintered part 1.

FIG. 4 shows a side view in section (left-hand side) and a perspective view in section (right-hand side) of a first embodiment variant of rolling tools 10 in the tool 6 according to FIG. 1. Reference is made to the embodiments relating to FIGS. 1 to 3.

The sintered part 1 has a first end face 2, a second end face 4 spaced apart in an axial direction 3, and a peripheral face 5 between the end fac-es 2, 4.

Each rolling tool 10 comprises a roller 21, which is guided at least in a peripheral direction 11 along the peripheral surface 5 of the sintered part 1. The second compressive force 9 is applied to the sintered part 1 via the roller 21. The roller 21 rolls on the sintered part 1 in the process. The outer peripheral surface of the roller 21 of the rolling tool 10 has a specific shape, with the result that this specific shape is transferred to the sintered part 1 via the rolling tool 10 in the course of the rolling operation. The roller 21 has a shoulder 22, which also supports the sintered part 1 with respect to the axial direction 3.

It can be seen here that grooves 23, that is to say undercuts, running around the periphery of the peripheral surface 5 of the sintered part 1 can be created via the roller 21. Furthermore, a homogeneous density can be achieved even in regions with a low wall thickness 24.

FIG. 5 shows a side view in section (left-hand side) and a perspective view in section (right-hand side) of a second embodiment variant of rolling tools 10 in the tool 6 according to FIG. 1. Reference is made to the statements relating to FIGS. 1 to 4.

By contrast to the first embodiment variant, the rollers 21 in this instance have a smooth outer peripheral surface. The roller also has a conical portion 25, the angle 26 with respect to the axial direction 3 being less than 60 angular degrees, in this instance approx. 20 angular degrees. It is possible to achieve a homogeneous density even in the conical portion 25 here, too.

LIST OF REFERENCE SIGNS

1 Sintered part
2 First end face
3 Axial direction
4 Second end face
5 Peripheral surface
6 Tool
7 First compressive force
8 Radial direction
9 Second compressive force
10 Rolling tool
11 Peripheral direction
12 Receptacle
13 Punching unit
14 Control unit
15 Processing tool
16 First tool part
17 Second tool part
18 Bearing
19 First mandrel
20 Second mandrel
21 Roller
22 Shoulder
23 Groove
24 Wall thickness
25 Conical portion
26 Angle

The invention claimed is:

1. A method for producing a sintered part, wherein the method comprises at least the following steps:

a) providing a sintered part, wherein the sintered part has a first end face, a second end face spaced apart in an axial direction, and a peripheral surface between the end faces;

b) arranging the sintered part in a tool;

c) using the tool to subject the sintered part to a first compressive force acting on the end faces at least in the axial direction, in which the sintered part is calibrated by the first compressive force;

d) subjecting the sintered part to a second compressive force acting on the peripheral surface at least in a radial direction, wherein the second compressive force is applied to the sintered part via at least one rolling tool comprising a roller which is guided in a peripheral direction along the peripheral surface of the sintered part, and wherein the sintered part is shaped at least by the second compressive force, or mechanically processing the sintered part, wherein steps c) and d) are carried out at least partially at the same time.

2. The method as claimed in claim 1, wherein the first compressive force is at least 200 megapascals.

3. The method as claimed in claim 1, wherein the first compressive force is applied to the sintered part over the entire first end face and the entire second end face.

4. The method as claimed in claim 1, wherein a plurality of rolling tools are arranged in the tool about the peripheral surface of the sintered part, wherein the second compressive force is applied to the sintered part at least intermittently at the same time by multiple rolling tools.

5. The method as claimed in claim 1, wherein the sintered part is pressed quasi-isostatically by the first compressive force and the second compressive force.

6. A tool for producing a sintered part by a method as claimed in claim 1, wherein the sintered part has the first end face, the second end face spaced apart in the axial direction, and the peripheral surface between the end faces, wherein the tool at least comprises:

a receptacle, in which the sintered part is arrangable for further processing, a punching unit for subjecting the sintered part arranged in the receptacle to the first compressive force for calibration of the sintered part, and at least one rolling tool for subjecting the sintered part arranged in the receptacle to the second compressive force in which the at least one rolling tool comprises a roller which is guided in a peripheral direction along the peripheral surface of the sintered part, or at least one processing tool for the mechanical processing of the sintered part arranged in the receptacle.

7. The tool as claimed in claim 6, at least comprising a control unit suitably designed to control the tool for the purpose of carrying out the method, wherein the control unit is able to control the first compressive force and additionally the second compressive force or the processing tool at least intermittently at the same time.

* * * * *